US009682272B2

(12) United States Patent
Januszek

(10) Patent No.: US 9,682,272 B2
(45) Date of Patent: Jun. 20, 2017

(54) WEIGHTED EXERCISE DEVICE

(71) Applicant: Escape Fitness Limited, Peterborough (GB)

(72) Inventor: Matthew Januszek, Peterborough (GB)

(73) Assignee: ESCAPE FITNESS LIMITED, Peterborough (GB)

( * ) Notice: Subject to any disclaimer, the term of this patent is extended or adjusted under 35 U.S.C. 154(b) by 140 days.

(21) Appl. No.: 14/640,965

(22) Filed: Mar. 6, 2015

(65) Prior Publication Data

US 2015/0251044 A1 Sep. 10, 2015

(30) Foreign Application Priority Data

Mar. 10, 2014 (GB) ..... 1404215.4

(51) Int. Cl.
*A63B 21/06* (2006.01)
*A63B 21/072* (2006.01)
(Continued)

(52) U.S. Cl.
CPC ..... *A63B 21/0724* (2013.01); *A63B 21/0603* (2013.01); *A63B 21/0608* (2013.01);
(Continued)

(58) Field of Classification Search
CPC ... A63B 15/00; A63B 15/005; A63B 21/0724; A63B 21/072; A63B 21/075;
(Continued)

(56) References Cited

U.S. PATENT DOCUMENTS 2,820,655 A 1/1958 Hileman
5,464,379 A 11/1995 Zarecky
(Continued)

FOREIGN PATENT DOCUMENTS

CN 202951170 U 5/2013

OTHER PUBLICATIONS

Search Report in Priority GB Application No. GB1404215.4, mailed Sep. 10, 2014.

*Primary Examiner* — Sundhara Ganesan
*Assistant Examiner* — Rae Fischer
(74) *Attorney, Agent, or Firm* — Troutman Sanders, LLP; Ryan A. Schneider

(57) ABSTRACT

A weighted exercise apparatus having a body section containing a flowable weighted material movable within the housing. The housing has a longitudinal axis and longitudinally opposed end sections. A connection socket is located at each end section. A pair of handle members correspond to the connection sockets, having a connection end received within an open end of the corresponding connection socket. Each handle member includes at least one radially extending retractable locking pin and a radially extending rigid projection. The corresponding socket includes a channel rotationally receiving the projection and at least one aperture to receive the at least one locking pin. The projection and at least one locking pin are arranged such that when the locking pin is aligned with and received within the aperture the projection is received and longitudinally restrained within channel providing a secure yet easily releasable method of rotationally locking the handle relative to socket.

14 Claims, 3 Drawing Sheets

(51) Int. Cl.
*A63B 23/035* (2006.01)
*A63B 21/00* (2006.01)

(52) U.S. Cl.
CPC ..... *A63B 21/072* (2013.01); *A63B 21/4035* (2015.10); *A63B 23/03525* (2013.01); *A63B 21/4021* (2015.10); *A63B 2210/50* (2013.01); *A63B 2225/09* (2013.01); *Y10T 29/49888* (2015.01)

(58) Field of Classification Search
CPC ..... A63B 21/0603; A63B 21/0728; A63B 21/4021; A63B 2210/50; A63B 2225/09
See application file for complete search history.

(56) References Cited

U.S. PATENT DOCUMENTS

| | | | | |
|---|---|---|---|---|
| 8,262,546 | B1 * | 9/2012 | Lashinske ..... | A63B 21/0602 482/109 |
| 2003/0233718 | A1 | 12/2003 | Heathcock et al. | |
| 2009/0208282 | A1 | 8/2009 | Hale | |

* cited by examiner

WEIGHTED EXERCISE DEVICE

CROSS REFERENCE TO RELATED APPLICATIONS

This application claims the benefit of UK Patent Application No. 1404215.4, filed 10 Mar. 2014, the entire contents and substance of which is hereby incorporated by reference.

BACKGROUND OF THE INVENTION

1. Field of the Invention

The present invention relates to a weighted exercise device, and in particular an inertial exercise device containing a flowable weighted material.

2. Description of Related Art

Conventional weight training exercises for building muscle strength uses fixed, 'static' weights which are lifted by the user to exercise skeletal muscles. During lifting a gravitational force acts on the weights and the user opposes this force through concentric or eccentric contraction of the muscles. Weight lifting is typically performed in a controlled manner across a limited range of movement at a relatively low speed with little dynamic movement, and will generally activate only a specific group of muscles required to perform the lift.

There is increasing focus on the importance core or stabilizing muscles. Core muscles are those muscles found in the stomach area and around the mid and lower back, as well as in the hips, the shoulders and the neck. Core muscles are important in functional movements, and it is considered that poor core muscles core development can predispose a person to injury. However, core muscles are not fully activated in the majority of weight lifting exercises.

A further identified problem with static weight lifting is that the range of movements performed to lift a static weight is limited. In addition, the dynamic range of the applied force is very limited. There are specific benefits to be achieved by performing exercise that cause the muscles to operate over an expanded range, during which the muscles and tendons are stretched. There are also known benefits to activating muscles in a more explosive manner across a greater dynamic range.

Devices are known for enabling stretching and extension of the muscles during weight lifting exercise. Such known devices operate on an inertial principle and include a movable, dynamic weight element that moves relative to the main body of the device during operation. As such, when the direction of movement of the device is changed the inertial weight element continues moving in the initial direction under its own momentum until impact with the body causes it to stop. Such devices have been shown to generate jerky, high impact forces that can result in muscle strain or joint injury. Such devices also tend to be limited to a specific range of movement. A further problem identified with inertial training devices is that the forces generated between the body and the inertial weight element can lead to rattle, loosening or failure of the components, particularly any handle or grip portions through which the forces are directed.

Accordingly, it is an object of the present invention to provide a new and improved weighted exercise device for physical conditioning.

It is therefore desirable to provide an improved weighted exercise device which addresses the above described problems and/or which offers improvements generally.

BRIEF SUMMARY OF THE INVENTION

According to the present invention there is provided a weighted exercise device as described in the accompanying claims.

In an embodiment of the invention there is provided a weighted exercise apparatus comprising a hollow body section containing a flowable weighted material that is movable within the housing, the housing having a longitudinal axis and longitudinally opposed end sections; a connection socket located at each end section; and a pair of handle members corresponding to the connection sockets each having a connection end sized and configured to be received within an open end of the corresponding connection socket. Each handle member includes at least one radially extending retractable locking pin and a radially extending rigid projection, and the corresponding socket includes a channel extending around part of the inner circumference for rotationally receiving the projection and at least one aperture configured to receive the at least one locking pin, the projection and at least one locking pin being arranged such that when the locking pin is aligned with and received within the aperture the projection is received and longitudinally restrained within circumferentially extending channel. In this arrangement the locking pin provide a secure yet easily releasable means of rotationally locking the handle relative to socket while the rigid projection bears the large longitudinal forces experienced during use.

Each socket preferably includes a longitudinally extending first channel section extending inwardly from the open end of the socket and a circumferentially extending second section at its inner end arranged transversely to the first section defining said channel extending around part of the inner circumference, the projection and at least one locking pin being arranged such that when the projection is received within the first longitudinal channel section the at least one locking pin is angularly misaligned with the corresponding aperture and such that when the projection is longitudinally aligned with the second circumferential channel section the locking pin is longitudinally aligned with the aperture, the handle being rotatable relative to the socket when the projection is received within the second channel section to enable the locking pin to align with and project into the aperture to rotationally lock the handle relative to the socket, and the projection and at least one locking pin being further arranged such that when the locking pin is aligned with and received within the aperture the projection is angularly misaligned with the first section of the channel to retain it within the second circumferential channel section to longitudinally lock the handle relative to the socket.

The first longitudinal channel section advantageously rotationally restricts the handle during insertion to ensure angular misalignment of the pins and apertures.

The at least one retractable pin may be a radially extending sprung pin retractable within the handle and preferably at least two locking pins provided at circumferentially spaced locations around the handle. The at least two locking pins are preferably longitudinally aligned and located at diametrically opposed positions to optimize rotational locking.

Each handle preferably further comprises at least one radially extending actuating member located inwardly along the length of the handle from the at least one locking pin, the at least one actuating member being operably connected to the at least one locking pin such that compression of the actuating member causes retraction of the at least one locking pin.

The actuating member may comprise at least two diametrically opposed sprung pins operatively connected to the at least two locking pins at common circumferential positions arranged such that inward compression of the actuating pins causes simultaneous inward retraction on the locking pins. The actuating pins are located at a position such that they are longitudinally spaced inwardly along the handle away from the distal end of the socket when the handle is fully received in the socket. As such the actuating pins remain exposed while the locking pins are received within the socket and may be compressed to a greater distance than the locking pins by the user due the lack of interference caused by the socket wall, thereby allowing maximum retraction of the pins to make retraction of the handle as effortless as possible.

The distal ends of the locking pins preferably comprise a domed configuration providing a curved leading edge generating a camming action to facilitate further retraction of the pins as the handle is inserted.

The handles preferably each comprise a strap secured to the handle and comprising a loop configured to receive a user's hand. The strap is adjustable to vary the size of the loop to prevent removal of the inserted hand. As such the handle may be tethered to the user's wrist during use to prevent accidental release.

Each handle preferably includes a convex region of increased diameter to provide longitudinal resistance to a user's hand sliding along the handle.

The flowable weighted material preferably comprises spherical metal pellets which are preferably steel shot.

In another aspect there is provided a weighted exercise apparatus comprising a hollow body section containing a flowable weighted material that is movable within the housing, the housing having a longitudinal axis and longitudinally opposed end sections. The flowable weighted material comprises spherical metal pellets and a lubricating oil, and the volume of lubricating liquid being in the range of 0.5 to 1.5 ml per 1 kg of metal pellets. This has been found to provide the optimum flow performance for the shot.

The volume of lubricating oil is preferably in the range of 0.8 to 1.2 ml per 1 kg of metal pellets and more preferably is 1 ml per 1 kg of metal pellets.

In another aspect of the invention a method of manufacturing a weighted exercise device comprises providing a hollow housing formed from two separate hollow body sections; filling the two body sections with a predetermined volume of spherical metal pellets that is less than the volume of housing, adding to the metal pellets a volume of lubricating oil in the range of 0.5 to 1.5 15 ml per 1 kg of metal pellets, securing together the two body sections to form the sealed hollow housing, and agitating the housing cause the lubricating oil to coat the metal pellets.

The volume of lubricating oil is preferably in the range of 0.8 to 1.2 ml per 1 kg of metal pellets and more preferably 1 ml per 1 kg of metal pellets.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1A:
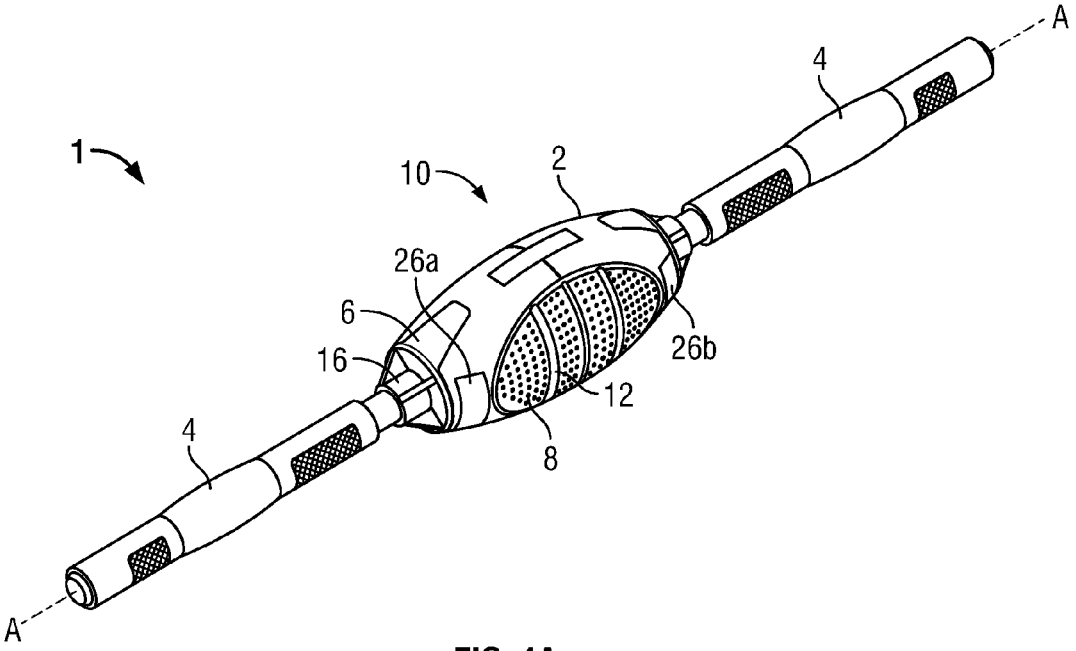
FIGS. 1A and 1B shows an exercise apparatus according to an embodiment of the invention in isometric (FIG. 1A) and front view (FIG. 1B)

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Figure 1B:
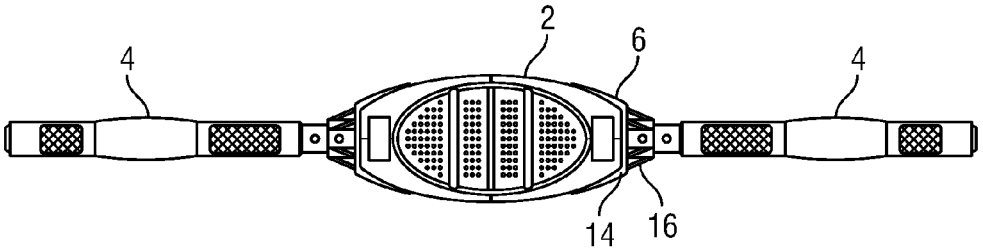

Referring to FIGS. 1A and 1B there is provided an exercise device 1 comprising a body section 2 and handles 4. The body section 2 is substantially cylindrical having a longitudinal axis A-A extending between opposed longitudinally spaced ends 6. The body 2 has a generally ovoid or ellipsoid shape, radially tapering inwardly in a curved manner from the longitudinal centre point towards the spaced apart longitudinally opposed ends 6.

The outer surface of the body 2 comprises grip section 8 on diametrically opposed sides of the body 2. The grip sections 8 include a recessed section spaced radially inwardly of the main outer surface 10 of the body section 2, but following the generally shape thereof. The recessed section 8 provides a reduced diameter portion of the body that is more easily gripped by a user. To further assist the recessed sections 8 are covered in a high grip material such as polyurethane or rubber, and preferably include raised projections such as dimples configured to increased surface area that is rougher and therefore provides better grip than the main surface 10. A plurality of ridges 12 extend circumferentially across the recessed sections 8 in a direction transverse to the longitudinal axis A-A. The ridges are raised relative to the recessed surface 8 and provide longitudinal engagement edges against which the user's fingers may abut when gripping the grip sections 8 to provide resistance to longitudinal movement relative to the hands.

The handles 4 extend transversely from the opposing ends 6 of the body section 2. The body section 2 is truncated at the ends 6 to define disc shaped end surfaces 14 arranged perpendicular to the longitudinal axis A-A. Hollow cylindrical handle receiving sockets 16 extend longitudinally outwardly from the end surfaces 14. The sockets 16 are configured to removably receive and retain the end sections of the handles 4, as will be discussed in further detail below. The handles 4 include longitudinally spaced grip portions 18 that are interspaced by an expanded region 20. The expanded region 20 tapers radially outwards in a curved manner from either end towards the midpoint defining a convex bulbous configuration. The expanded region 20 acts as a longitudinal stop to prevent the user's hands sliding along the handle in use when imparting or receiving a longitudinal force from the body 2.

Figure 2:
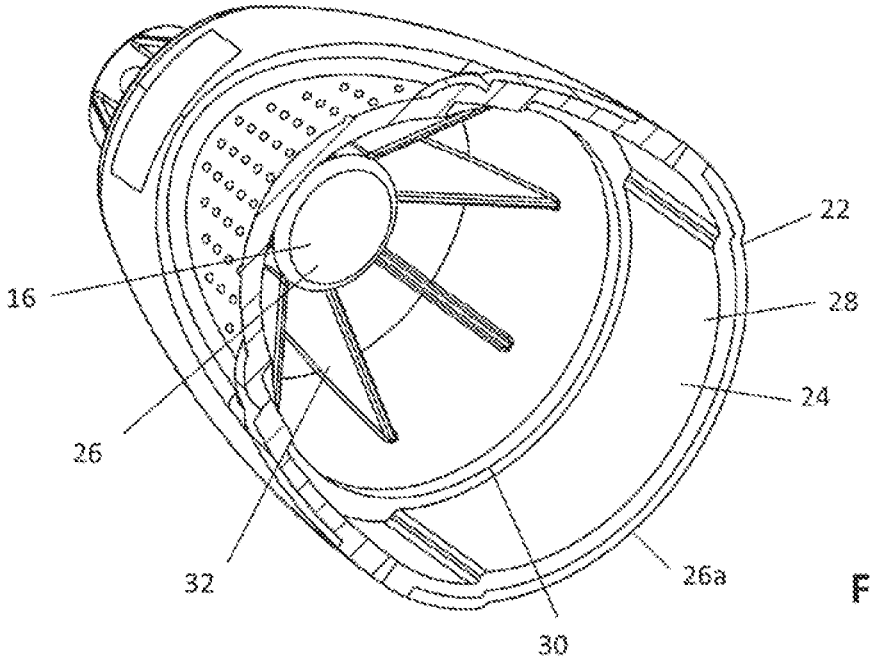
FIG. 2 shows a hollow body section of the apparatus of FIGS. 1A and 1B from the inner end.

As shown in FIG. 2, the body 2 is a hollow shell comprising a wall 22 defining an inner cavity 24. The body 2 is formed as two parts 26*a* and 26*b*, separated at the longitudinal midpoint between the opposed ends 6. Each half section 26 defines a hollow cup for containing a weighted flowable material. The cylindrical handle socket 16 extends into the base of the end section 26 into the cavity 24. The socket 16 terminates at and is 15 closed by an end wall 26. The body sections 26 are connected to each other by any suitable means, which may include complimentary threads, or adhesive or other bonding means.

Preferably a connection ring is provided (not shown) that is received within in an inner stepped section 28 formed on the inner surface of the wall 22 proximate the outer edge, terminating at its inner end with a radial step 30 defining a stop. The connection ring is concentric with the body 2 and has an outer diameter corresponding to the inner diameter of the stepped section 28, and has a length equal to twice the length of the stepped section 28 such that it extends longitudinally along both stepped sections 28 when the halves 26 are connected. The connection ring is bonded to the stepped section 28 of both halves to hold the halves 24 together. The connection ring is keyed relative to the body 2 to prevent relative rotation. A viscous mass is carried in the inner cavity, the viscous mass filling the inner cavity less than full to allow the viscous mass to move within the inner cavity 24.

Figure 3:
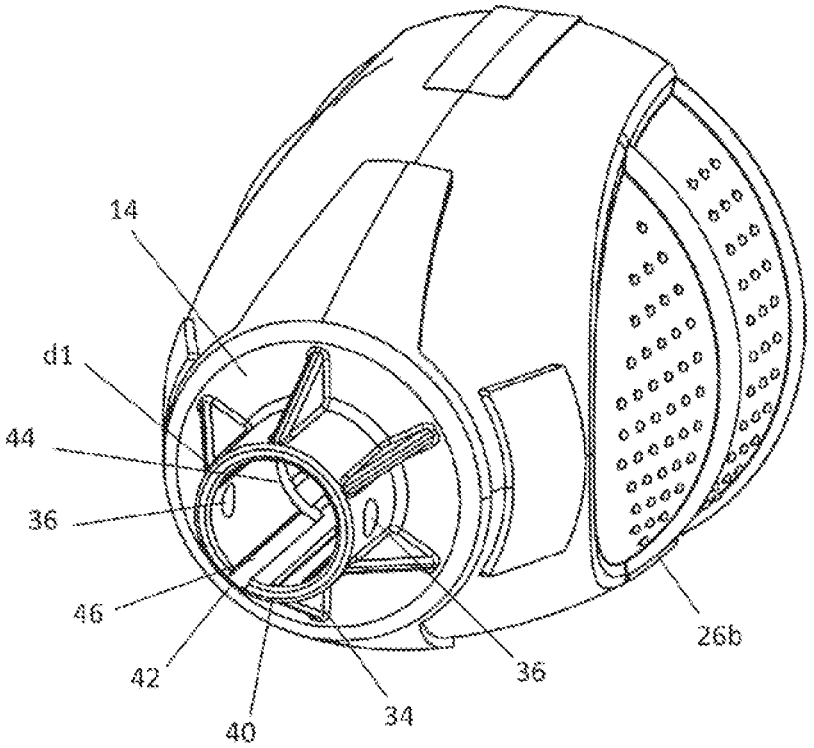
FIG. 3 shows a hollow body section of the apparatus of FIGS. 1A and 1B from the outer end.

The inner end of the sockets 16 extends into the cavity 24 of the body sections and radially extending fins 32 extend outwardly from the socket 16 connecting the outer wall of the socket 16 with the inner surface of the wall 22. The fins 32 provide rigid support for the inner end of the socket 16. As shown in FIG. 3 fins 34 also extend from the outer surface of the outer end of the socket 16 and connect to the end walls 14 to provide lateral support for the free end of the socket 16.

A flowable mass (not shown) is provided within the inner cavity 24. The flowable mass is preferably a dense particulate material such as metal pellets or sand. The flowable material is preferably configured to have a viscous flowable property and is able to flow within the cavity 24. The volume of flowable material is selected to provide a desired weight and flow property and can be varied depending on the characteristics required. The volume of the flowable material must be less than the volume of the cavity 24 on order to provide free space for the material to move within the cavity.

The flow properties of the weighted material are important to the performance of the apparatus 1 and to achieving a desirable 'feel' in term of the physical feedback to the user when using the apparatus. It has been found that rounded metal shot pellets provide the optimum balance of weight and flow characteristics that is flowable while maintaining the inertial characteristics of an integral mass. To allow the metal shot to flow in an optimal manner a lubricant is added to the shot. It has been found that the optimum combination is steel shot and an oil lubricant, and that the ration of oil to shot is significant in achieving the desired flow characteristics. It has been determined that the volume of oil must be selected to suitably coat each pellet and to provide surface cohesion between the pellets, while minimizing the lubricant. The applicant has determined that the optimum shot to oil ratio is approximately 1 ml of oil per 1 kg of shot. It had considered that a significantly greater volume of oil would be required to properly lubricate this volume of shot. However, it has been surprisingly found that volumes above this level leads to excess oil flowing within the cavity independently of the shot which inhibits rather than promoting the desired flow characteristics of shot, as well as presenting potential leakage issues. The desired range is therefore between 0.5 and 1.5 ml per 1 kg of shot, more preferably 0.8 to 1.2 ml per 1 kg and most preferably 1 ml of oil per 1 kg of shot.

At this reduced volume of oil a suitable methodology must be adopted to ensure complete coating of the shot, without which the shot will not flow as desired. The oil has a density of between 0.8 and 0.9 at 15° C. with an ISO viscosity grade of between 32 and 36 at 40° C. The shot is initially cleaned and degreased prior to weighed and then inserted into a container, which may be the cavity 24 or may be a further container. The required measure of oil is then added and the shot is agitated to promote coating. In a preferred method, the shot is poured into the body sections 26 and the required volume of oil added. The body sections 26 are then sealed together. The apparatus is then gripped and rotated 360 degrees for at least 10 rotations about its centre transverse to the longitudinal axis in a first horizontal plane and then 360 degrees about the same centre point on a vertical plane for a further at least 10 rotations.

In use, the user grips the apparatus 1 by the handles 4 and/or the grip sections 8. The user rapidly imparts a force to the apparatus to accelerate the body 2 in a direction substantially parallel to the longitudinal axis A-A. As the body 2 is accelerated the flowable mass initially remains substantially stationary due to its inertia. As the trailing inner end wall of the cavity 24 engages the mass it is accelerated with the body 2. Once the apparatus 1 has been moved across a predetermined arc of movement the user then rapidly accelerates it in the return direction. The generated momentum of the flowable mass causes it to continue in the first direction until it fully engages the end wall of the cavity 24 moving in the opposite direction and is engaged and accelerated in the return direction with the body. Each movement therefore requires more than one impulse from the user to initially accurate the body 2 and to then counter the inertial force of the flowable mass.

The point at which the rapid and abrupt change of direction occurs is referred to as the Transformational Zone. This is the portion of time when muscular loading is transformed to a muscular explosion. This reaction occurs reaction occurs over a specific zone of the movement. The mode of operation of the apparatus causes the core muscles to automatically activate in the Transformation Zone in response to the generated forces. Due to momentum of the flowable mass, an apparatus having a mass of 4 kg may have an effective mass of up to 20 kg depending on the speed and direction in which the apparatus is moved. This additional force is countered by the engagement of core muscles rather than additional burden on the primary muscle group performing the operation, thereby activating a wider range of muscles and minimizing fatigue.

Due to the high effective forces generated when the apparatus 1 is rapidly accelerated in opposing directions, it is essential that the connection between the handles 4 and the body 2 is secure. Failure of these connections could result in the body 2 being thrown across a gym space resulting in a serious risk of injury to other gym users. The handle is therefore providing with a double securing means. As shown in FIG. 3 a pair of apertures 36 extend through the wall 38 of the socket 16 at axially aligned and diametrically opposed locations longitudinally spaced inwardly of the open end 40 of the socket 16. A longitudinally extending channel 42 extends along the inner surface of the socket 16 and is circumferentially spaced from the apertures 36. The channel 42 is parallel with the longitudinal axis and has an opening 44 at a first end coincident with the opening 40 of the socket 16. The channel 42 has a main longitudinally extending channel section 46 and an inner end section 48 that extends in a circumferential direction transversely and perpendicular to the longitudinal direction of the main channel section 46. The end section 48 is longitudinally spaced inwardly of the apertures 36.

Figure 4:
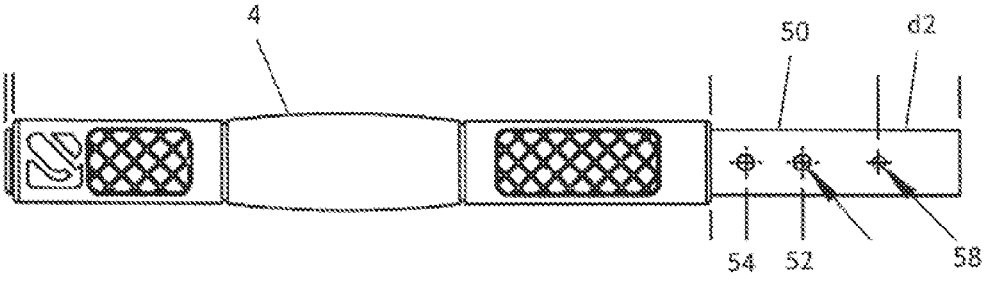
FIG. 4 shows a handle of the apparatus of FIGS. 1A and 1B.

Referring to FIG. 4, each socket 16 has an inner diameter d1 and each connection end 50 of the handles 4 has a diameter d2 corresponding to the diameter d1 such that the end 50 is received within the socket 16 with a close tolerance sliding fit. The end section 50 includes a first pair of retractable pins 52 located on diametrically opposed side of the handles. The pins 52 project radially outwardly from the end section 4 and are spring loaded such that compression of the pins 52 causes them to retract inwardly within the end section 50. A second set of pins 54 are spaced inwardly along the end section 50 form the first pins 52. The second set of pins 54 are spring loaded and are connected to the first set of pins 52 such that inward compression of the second pins 52 causes retraction of the first pins 52. The first pins 52 are configured and arranged to be received within the apertures 36 with the distance from the pins 52 to the inner end of the handle 4 being equal to or less than the distance from the apertures 36 to the inner end of the socket 16.

The free ends of the pins 52 have a domed configuration.

The end section 50 also includes a radially extending projection or spigot 58 located lengthwise outwardly of the first pins 52. The projection 58 is rigid and fixed and is arranged to be received in the channel 36. The distance between the projection 58 and the first pins 52 is equal to the distance between the end section 44 of the channel and the apertures 36.

In use the second pins 54 are compressed to retract the first pins 52. The projection 58 is them aligned with the channel 42 and the end section 50 is inserted into the socket 16. As the end section 50 extends into the socket 16 the projection 58 is received and slides within the channel 42. This prevents the end section 50 from rotating relative to the socket 16 and causes the end section to be received in a fixed angular position relative to the socket. The circumferential positioning of the pins 52 relative to the projection 58 is selected such that the relative angular positions of the two components is different from the relative angular positions of the channel 42 and the apertures 36. In this way, when the projection 58 is angularly aligned with the channel 42 the pins 52 are angularly and circumferentially misaligned with the apertures 36. In the embodiment shown the pins 52 and projection 58 are angularly aligned with each other while the channel 42 and aperture 36 are offset. In this way, when the projection is longitudinally aligned with the end section 48 of the channel 42 the pins 52 are longitudinally aligned but angularly misaligned with the apertures 36. At this point the handle 4 may be rotated such that the projection 58 translates within the circumferentially extending end section 48. The length of the end section 48 is selected such that the handle is able to rotate until the pins 52 align with the apertures 36. At this point the pins 52 spring into the apertures 36 to 30 rotationally lock the handle 4 relative to the socket. At the same time, the projection 58 is longitudinally fixed within the end section 48.

While the sprung pins 52 provide both rotational and longitudinal locking, it was found that the large longitudinal loading experienced by the apparatus 1 resulted in a risk of the pins releasing in use. While this could be mitigated by increasing the spring force of the pins 52, this would result in pins that require too great a force for a user to easily compress them to insert or release the handles 4. The projection 58 is rigid and therefore provides greater resistance to the longitudinal forces and removes the longitudinal loading from the pins 52. The rotational forces are far less and the sprung pins 52 are therefore more than sufficient to retain the handle in this direction. The combination of the pins 52 and the rigid projection 58 therefore provides a highly secure handle arrangement that is also easily removable for transit.

Figure 5:
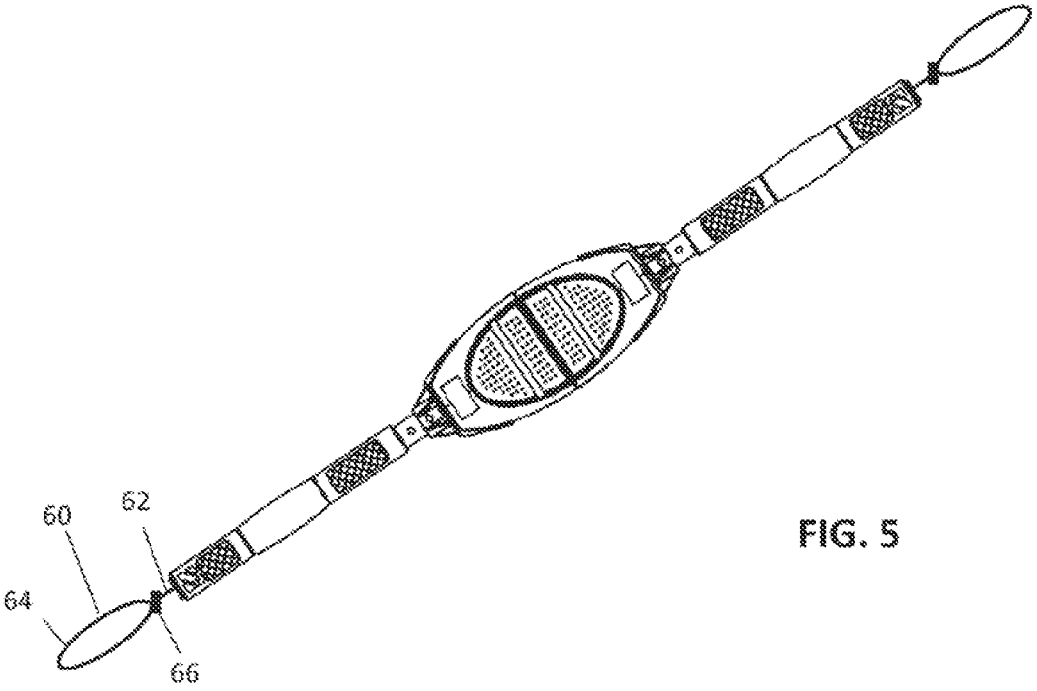
FIG. 5 shows an exercise apparatus according to an embodiment of the invention.

To further improve the safety of the apparatus 1, straps 60 are provides at the free ends of each handle 4, as shown in FIG. 5. The straps 60 comprise a proximal cord section 62 connected to and extending from and connected to the handle 4. A loop section 64 is provided at the distal and having an adjustable spring loaded clamp 66 for varying the size of the loop 64. The loop 64 is configured to receive a user's hand. In use the user extends their hand through the strap 60 before tightening the clamp to decrease the size of the loop 64 such that it is closely received around their wrist and such that their hand cannot be retracted. The then grips the handle 4, and should they release their grip in use the apparatus would remain tethered to their wrist preventing it from being thrown any distance.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A weighted exercise apparatus comprising:

a hollow, ovoid body section comprising a housing having a longitudinal axis and longitudinally opposed end sections and containing a flowable weighted material that is movable within the housing;

a connection socket located at each end section; and a pair of handle members corresponding to the connection sockets each having a connection end sized and configured to be received within an open end of the corresponding connection socket;

wherein each handle member includes a radially extending retractable locking pin and a radially extending rigid projection, and the corresponding socket includes a channel extending around part of the inner circumference for rotationally receiving the projection and a aperture configured to receive the locking pin, the projection and a locking pin being arranged such that when the locking pin is aligned with and received within the aperture the projection is received and longitudinally restrained within circumferentially extending channel; and wherein each socket includes a longitudinally extending first channel section extending inwardly from the open end of the socket and a circumferentially extending second channel section at its inner end arranged transversely to the first section defining the channel extending around part of the inner circumference, the projection and a locking pin being arranged such that when the projection is received within the first longitudinal channel section the locking pin is angularly misaligned with the corresponding aperture and such that when the projection is longitudinally aligned with the second circumferential channel section the locking pin is longitudinally aligned with the aperture, the handle being rotatable relative to the socket when the projection is received within the second channel section to enable the locking pin to align with and project into the aperture to rotationally lock the handle relative to the socket, and the projection and a locking pin being further arranged such that when the locking pin is aligned with and received within the aperture the projection is angularly misaligned with the first section of the channel to retain it within the second circumferential channel section to longitudinally lock the handle relative to the socket.

2. The weighted exercise apparatus according to claim 1, wherein the retractable pin is a radially extending sprung pin retractable within the handle.

3. The weighted exercise apparatus according to claim 1, further comprising a second locking pin, wherein the first and second locking pins are located at circumferentially spaced locations around the handle.

4. The weighted exercise apparatus according to claim 3, wherein the locking pins are longitudinally aligned and located at diametrically opposed positions.

5. The weighted exercise apparatus according to claim 2, wherein each handle further comprises a radially extending actuating member located inwardly along the length of the handle from the locking pin, the actuating member being operably connected to the locking pin such that compression of the actuating member causes retraction of the locking pin.

6. The weighted exercise apparatus according to claim 5, wherein the actuating member comprises at least two diametrically opposed sprung pins operatively connected to the at least two locking pins at common circumferential positions arranged such that inward compression of the actuating pins causes simultaneous inward retraction on the locking pins.

7. The weighted exercise apparatus according to any one of claim 3, wherein the distal ends of the locking pins comprise a domed configuration.

8. The weighted exercise apparatus according to claim 1, further comprising a strap secured to each handle and having a loop configured to receive a user's hand.

9. The weighted exercise apparatus according to claim 8, wherein the strap is adjustable to vary the size of the loop to prevent removal of the inserted hand.

10. The weighted exercise according to claim 1, wherein each handle includes a convex region of increased diameter to provide longitudinal resistance to a user's hand sliding along the handle.

11. The weighted exercise apparatus according to claim 1, wherein the flowable weighted material comprises spherical metal pellets.

12. The weighted exercise apparatus according to claim 1, wherein the flowable weighted material comprises spherical metal pellets and a lubricating oil, and the volume of lubricating liquid being in the range of 0.5 to 1.5 ml per 1 kg of metal pellets.

13. The weighted exercise apparatus according to claim 12, wherein the volume of lubricating oil is in the range of 0.8 to 1.2 ml per 1 kg of metal pellets.

14. The weighted exercise apparatus according to claim 13, wherein the volume of lubricating oil is 1 ml per 1 kg of metal pellets.

* * * * *